United States Patent [19]

Howard

[11] 4,363,519

[45] Dec. 14, 1982

[54] CONTINUOUS MINING MACHINE

[75] Inventor: Thomas E. Howard, Wheatbridge, Colo.

[73] Assignee: Joy Manufacturing Company, Pittsburgh, Pa.

[21] Appl. No.: 196,513

[22] Filed: Oct. 14, 1980

[51] Int. Cl.[3] ..... E21C 29/00; E21C 33/00

[52] U.S. Cl. ..... 299/31; 299/30; 299/64; 299/70; 173/23; 173/27; 173/46

[58] Field of Search ..... 299/30, 31, 56, 57, 299/64, 70, 69; 173/23, 27, 46

[56] References Cited

U.S. PATENT DOCUMENTS

| | | | |
|---|---|---|---|
| 1,715,745 | 6/1929 | Edmondson | 180/8 C |
| 2,753,971 | 7/1956 | Ball | 198/7 |
| 2,781,927 | 2/1957 | Holopainen | 214/138 |
| 3,119,506 | 1/1964 | Bridge et al. | 214/670 |
| 3,144,138 | 8/1964 | Brown et al. | 212/145 |
| 3,167,188 | 1/1965 | Burgess | 212/145 |
| 3,212,659 | 10/1965 | Koch | 214/132 |
| 3,310,181 | 3/1967 | Symmank | 212/145 |
| 3,351,221 | 11/1967 | Smalley | 214/138 |
| 3,433,374 | 3/1969 | Menzi | 214/138 |
| 3,635,364 | 1/1972 | Tlagleff | 214/138 |
| 3,744,574 | 7/1973 | Carley | 173/27 |
| 3,768,674 | 10/1973 | Menzi | 214/132 |
| 3,773,118 | 1/1972 | Shanks et al. | 299/70 X |
| 3,823,902 | 7/1974 | Bumueller | 173/27 X |
| 3,873,159 | 3/1975 | Dabell et al. | 299/64 |
| 3,989,149 | 11/1976 | Smith et al. | 214/138 R |
| 4,047,762 | 9/1977 | Bamford et al. | 299/64 |
| 4,192,551 | 3/1980 | Weimer et al. | 299/30 X |
| 4,243,107 | 1/1981 | Shook | 299/70 X |

FOREIGN PATENT DOCUMENTS

| | | |
|---|---|---|
| 610841 | 12/1960 | Canada . |
| 729063 | 3/1966 | Canada . |
| 1194788 | 6/1970 | United Kingdom . |

*Primary Examiner*—Ernest R. Purser
*Attorney, Agent, or Firm*—E. L. Levine

[57] ABSTRACT

A mining machine for performing a continuous mining operation in hard rock. The operating portions of the machine are mounted on substantial deck sections hingedly connected to each other to promote maneuverability of the machine in confined spaces. A mining implement capable of breaking ore from the solid is mounted on a rotatable, extensible boom and broken ore is collected by power operated means also provided on the machine. The machine may be adapted for remote operation through a remote hydraulic and/or electric control and may be provided with optional wheels or alternatively may be self propelled.

11 Claims, 10 Drawing Figures

CONTINUOUS MINING MACHINE

BACKGROUND OF THE INVENTION

In certain types of underground metal ore mining it is common to break up the rock face by drilling and blasting. The rubble or broken ore is then removed by a mucking operation. Usually the necessary operations are intermittent and successive. For example, blasting holes are drilled, the drilling machine is moved out, explosive handlers come in to place charges in the holes and detonate them and then a loader or other loading and/or transporting machine is brought in to gather and/or pick up the rubble or broken ore and move it away from the mining face. This type of mining is slow and awkward and greatly limits the productive capacity of the men and machines.

There have recently been developed high blow energy hydraulic hammers or impactors adapted for impact breaking of rock from the solid. One of these hydraulic impactors is shown in U.S. Pat. No. 4,089,380 which shows a machine in which kinetic energy of a reciprocating piston is transferred to the tool through a hydraulic coupling. (See also companion U.S. Pat. Nos. 4,062,268 and 4,012,909). Compared to other machines, these impact hammers, while sufficiently light and compact to be mounted on a hydraulic boom universally mounted so that it can direct the breaking force of the tool over substantially the whole of the face being mined, provide sufficient blow energy to break rock from the solid and therefore permit a non-cyclic, uninterrupted mining operation.

By employing high blow energy impactors on a movable machine with provision for mucking, continuous mining in hard rock can be accomplished.

SUMMARY OF THE INVENTION

This invention is directed to the provision of a machine highly suited to continuous mining of materials from solid ore bodies. It is a substantial and versatile machine which is relatively compact and light weight. It is particularily adapted for short wall slabbing in tabular horizontal ore bodies or for overhand cut and fill stopping in steeply dipping ore bodies with a long vertical dimension or for undercut and fill operations in steeply dipping ore bodies where ground conditions will not permit overhand methods. It may also be used for driving tunnels or headings in certain rock formations.

One form of the machine which comprises this invention also has mucking or gathering arms for gathering the broken materials and feeding them to a mucker or scraper which conveys the material away from the face through the machine to a conveyor, mine car or other transport facility by which it is ultimately transported out of the mine.

The machine has a high energy impactor carried by a gimbal mounted, extensible, hydraulic boom of known configuration.

For optimum stability this form of the machine sits on the ground or rigid structural sides beams or support members but has tramming capability necessary for its mining function. Mobility for tramming is provided by a system which utilizes the hydraulic boom and the bottom skid surfaces of the supporting side members or may be by means of any known system for permitting limited movement such as, for example, a hydraulically operated walking base (not shown) which can be used to move the machine longitudinally in step by step fashion. For long moves or transportation the machine can also be provided with wheels either removably mounted on a fixed axle in hubs on the side beams or mounted on pivoted levers so that they can be selectively pivoted into or out of ground engaging relationship. Wheels may be provided at both the front and rear of the machine and some or all of them may be located inside enclosures or recesses formed in the side beams to maintain minimum over-all width of the machine.

In an alternative form of the invention the machine may be mounted on a self-propelled chassis which may be of the well known endless tread crawler type or any other known type of chassis.

The boom is hydraulically operated and may be swung vertically, horizontally and turned about its longitudinal axis and the body of the hammer may be pivoted both horizontally and vertically with respect to the boom so that the tool may be positioned in almost any position desired under the control of the operator.

To move the machine when it is not mounted on a self-propelled chassis, the point of the tool is pressed against the ground by operation of the bottom to obtain a purchase against which force can be exerted, this same action reduces the pressure of the front of the machine on the ground making it easier to move. The boom may then be extended or retracted to provide backward or forward movement of the machine. To position the machine laterally, the boom is pivoted downward a sufficient amount to raise the front of the machine off of the ground and then the boom swung to one side. The lateral swinging of the boom with the point of the tool in contact with the ground will cause the front of the machine to pivot to the opposite side as may be desired for proper positioning. With appropriate attachments the boom may be adapted for holding or positioning timbers used to support the mine roof.

The machine has mucking or gathering arms which, in addition to their normal function of moving broken ore into the front of the mining machine, can be used like outriggers to provide stability to the machine. They can also be pivoted in the horizontal and vertical planes to provide greater versatility in the gathering function or to conform to variations in the ground surface and to a limited extent can be used in conjunction with the boom to propel the machine forward or backward on the skid surfaces of the support beams or on the optional wheels. If the front of the machine is raised slightly off the ground by pivoting the gathering arms in a downward vertical direction and the gathering arms are then swung in a horizontal direction the machine can also be positioned from side to side.

By virtue of the almost unlimited flexibility of positioning the breaking tool, the machine may be used to mine the face in a manner which most facilitates removal of the broken ore and least interferes with movement of the machine and further mining. For example, the ore may be broken along a diagonal so that the muck falls to one side or the other of the machine instead of in front of it or the cut may be made so that the working face is inclined outward from top to bottom causing the ore to fall away from the face, or the mining can be carried out combining the above angles so that the broken ore falls away from the face and to the side of the machine.

Two forms of muck handling apparatus may be provided for moving broken ore through the machine. One such type of mucker employs a mucking boom or stiff leg extending from the front of the machine and having a pulley at its forward end. A single scraper blade is drawn through the opening under the frame of the machine by a cable drawn over the front pulley and attached to one of the drums on a double drum hoist mounted on the rear of the machine. Another cable, attached to the other drum on the hoist and threaded over a pulley secured to a suitable anchor point behind the machine is used to pull the scraper and muck toward the rear of the machine. Another form of mucker consists of a plurality of vertical blades extending across the space provided in the underside of the machine and arranged so that they are free to pivot in one direction only from a vertical position to a horizontal position with the unattached or free ends of the blades facing the rear of the machine. The scraper blades are pivoted from a set of reciprocable rails which can be moved back and forth under the machine by a hydraulic cylinder. As the support rails are moved forward under the influence of the hydraulic cylinder the scraper blades will fold and ride over any muck they may encounter. When the cylinder is operated to cause the support rails and the scraper blades to move toward the rear of the machine the bottom edges of the scraper blades will dig into the muck moving it toward the rear of the machine. As this operation is continued the muck will be moved step by step from the front of the machine out the back where it may be loaded and/or conveyed by the mine transportation system out of the mine.

In alternative forms of the machine mucking is performed by a bulldozer type blade carried at the front of the machine or by a boom mounted side dump bucket. In these configurations the boom for the impactor is mounted on a base which can be slid back longitudinally of the machine to provide greater working clearance for the bulldozer or bucket.

Power for the booms and other hydraulically operated devices is provided by a hydraulic system mounted on the deck of the machine and powered by an electric motor, internal combustion engine or other prime mover. When the machine chassis is of the propelled type, motive power may be supplied from this hydraulic system to a hydraulic motor and gear box, or by an electric motor through a suitable gear box or by any other known conventional means and the prime mover may be located on the deck of the machine or on the chassis according to any suitable known arrangement. Power for the mucking hoist, when one is employed, may be provided by an electric motor, compressed air or any prime mover the same as or different than the prime mover for the hydraulic system. Suitable power supply connections and/or fuel supply and suitable electric wiring and fluid piping of conventional form are provided as necessary but are not shown.

For ease of transportation and for increased maneuverability when the machine is being moved from one mine face to another in an underground mine, the main frame of the machine is made in two sections which can be separated merely by removing two king pins. If only one king pin is removed, the two sections can be pivoted with respect to each other to help negotiate a tight turn.

An operator station and operating controls (not shown) may be provided on the machine or for improved operator safety and comfort the machine may be remotely operated by an operator who stands to the side or rear of the machine and manipulates the machine through a remote hydraulic and/or electric control terminal box connected by suitable cable and/or piping means to a control terminal on the machine.

It is an object of this invention to provide a continuous mining machine for mining hard rock ore from the solid in underground mines.

It is another object of this invention to provide a continuous mining machine for underground mining in hard rock and having means for gathering and transporting broken ore.

A further object of this invention is to provide an easily transportable underground continuous mining machine which is self-contained and self-propelled within the limits necessary to maintain mining contact with the ore being mined.

These and other objects and advantages of this invention will become apparent and become more fully understood from the following description and accompanying drawings.

IN THE DRAWINGS

Figure 3:
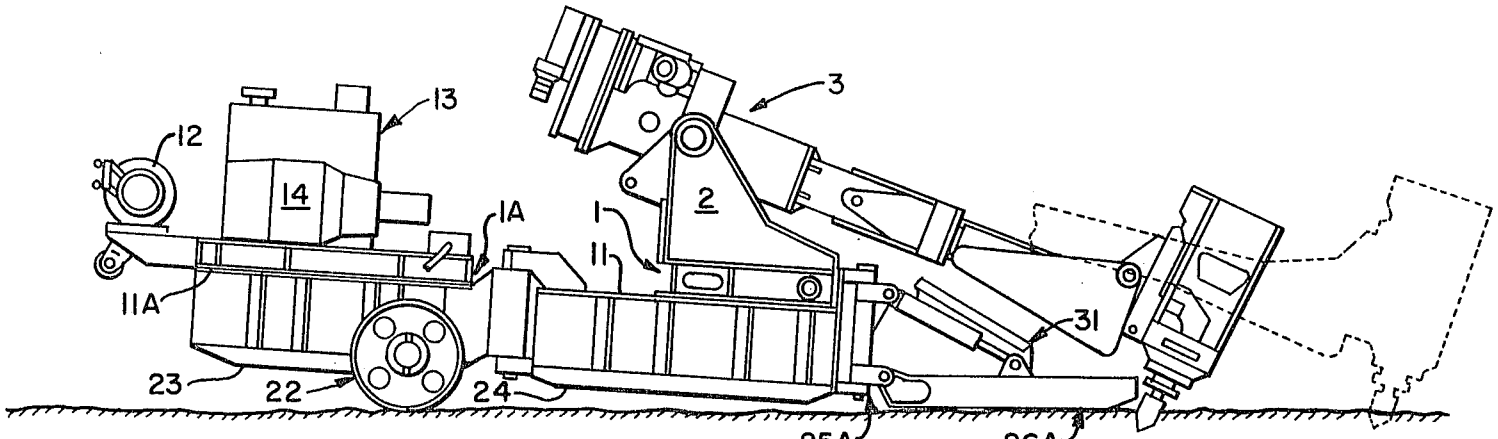

FIG. 3 illustrates the machine on optional wheels and after a tramming movement using the hydraulic boom. The broken lines illustrate the position of the breaking tool at the start of the tramming movement. The mucking apparatus is not shown in FIG. 3.

Figure 4:
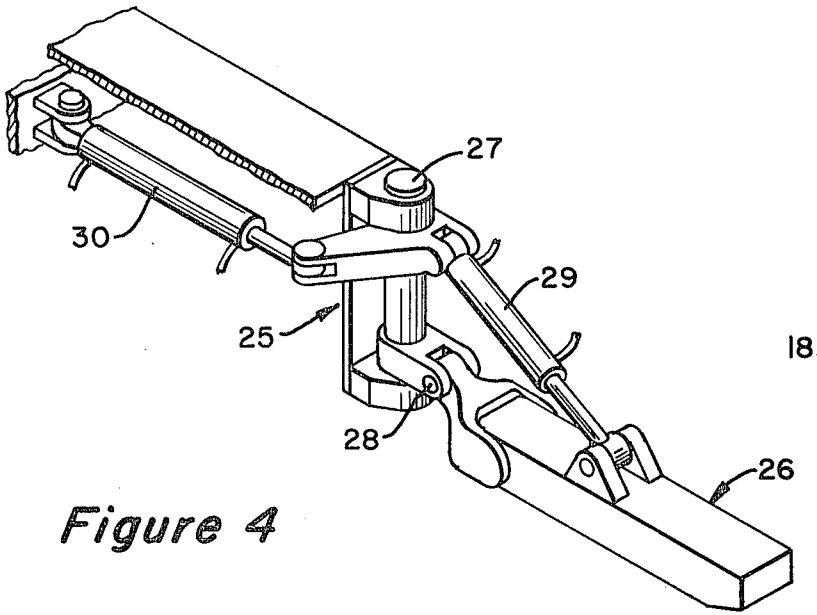

FIG. 4 shows details of the mucking arms and their operating cylinders, again with the plates omitted for clarity.

Figure 5:
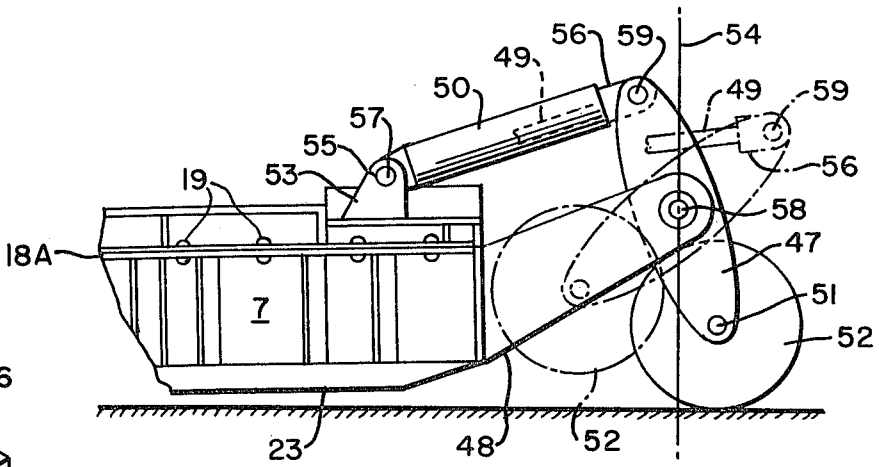

FIG. 5 illustrates a modified optional arrangement for mounting wheels.

Figure 6:
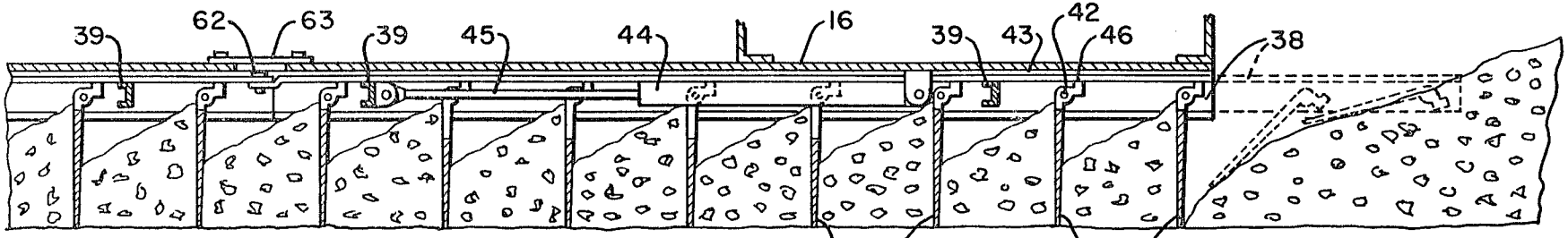

FIG. 6 is a partial view which illustrates an alternate form of mucker.

Figure 7:
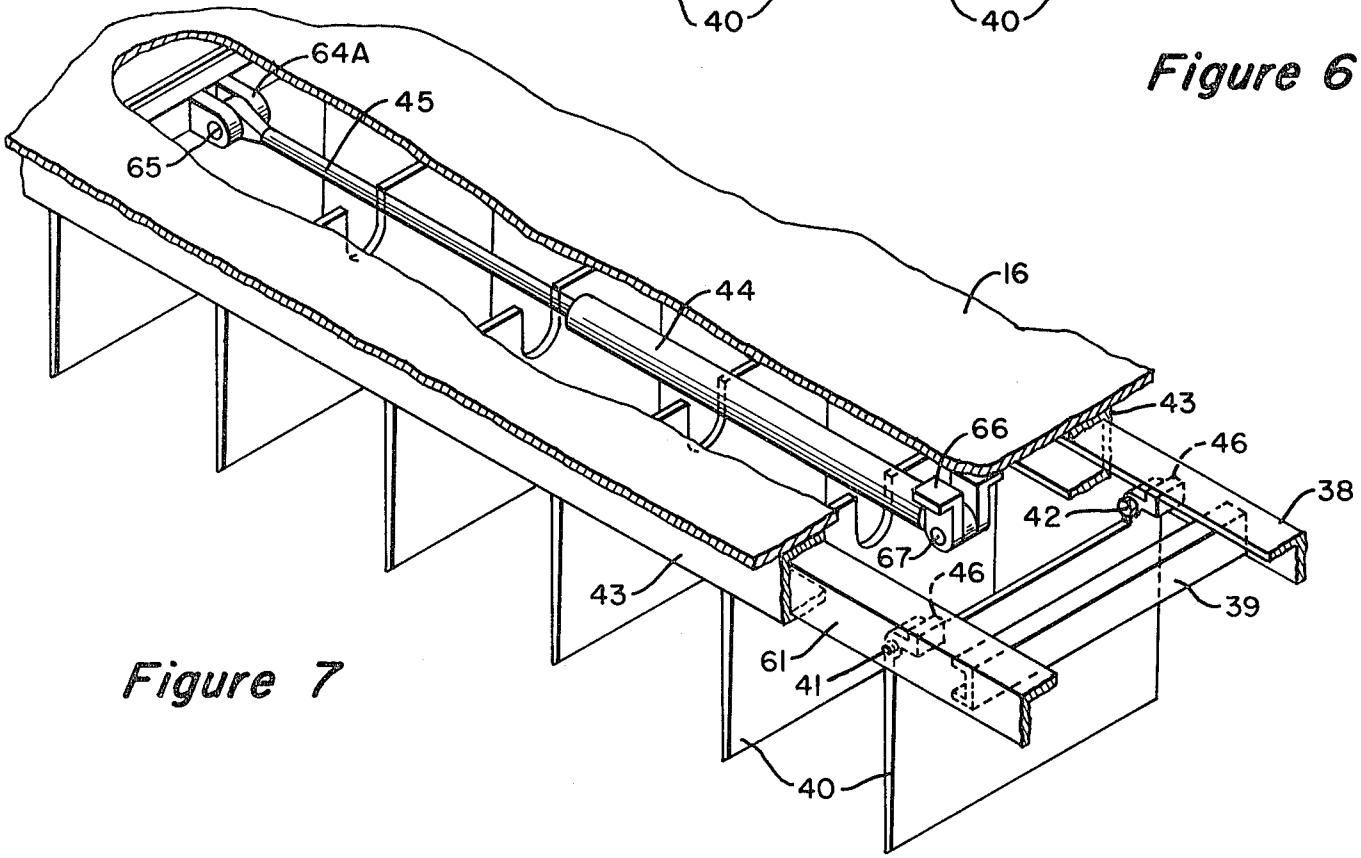

FIG. 7 is a partial view of the mucker of FIG. 6 with parts of the structure broken away to show the relationship of the operative elements.

Figure 8:
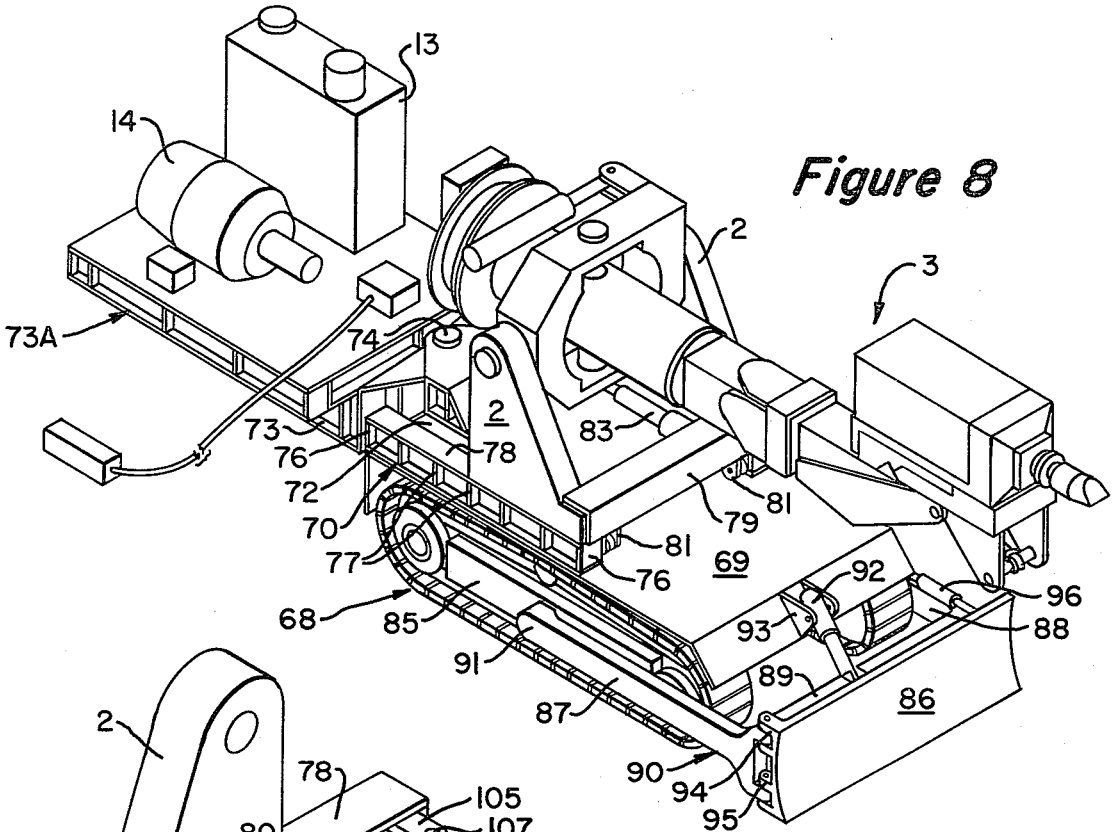

FIG. 8 is an isometric view of an alternative form of the machine provided with a bulldozer blade.

Figure 9:
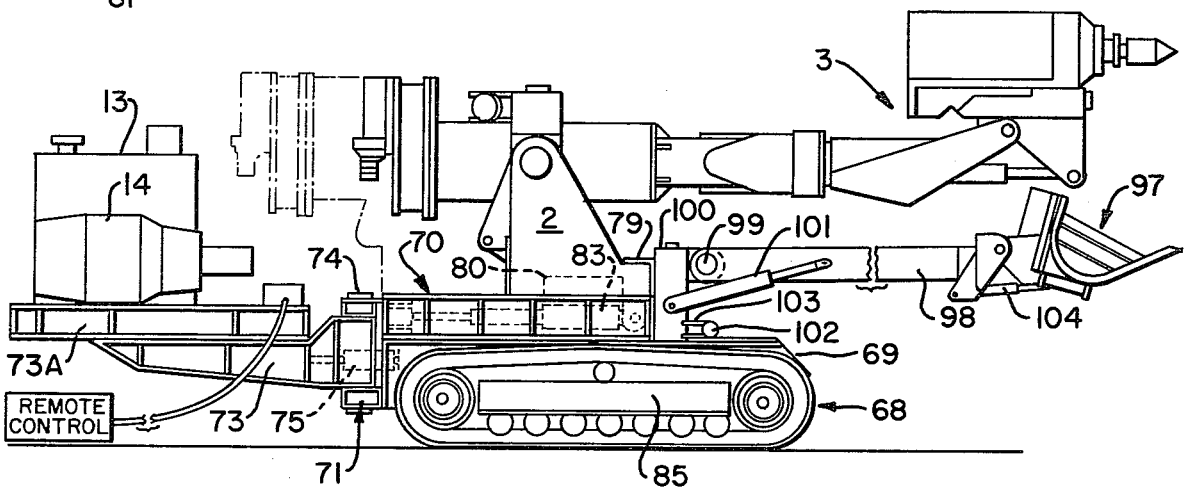

FIG. 9 is an elevation view of the machine in FIG. 8 but with a boom mounted side dumping bucket instead of a bulldozer blade.

Figure 10:
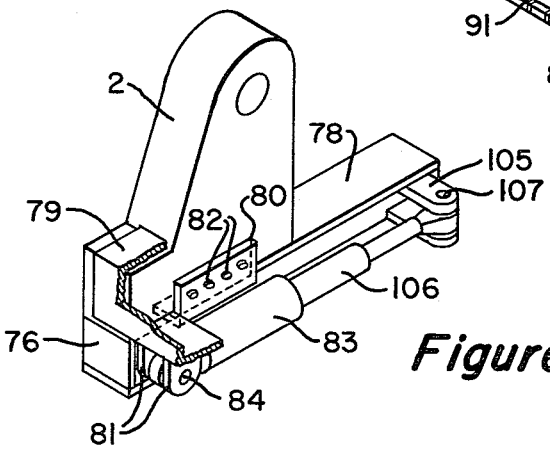

FIG. 10 is a detail view showing the sliding mount for the mining implement.

DESCRIPTION OF THE INVENTION

Referring now to the drawings, the machine consists of a main platform or deck 1 which carries the gimbal support structure or pedestals 2 on which is mounted the boom and hammer assembly 3. The platform 1 is supported by side beams 4 and 5. An auxiliary platform or deck 1A is supported by side beams 6 and 7. The side beams 4 and 6 are joined together by suitable means 8 and 9 and locked in place by removable king pins or bolts 10. Similarly side beams 5 and 7 are joined together by means 8A and 9A and locked in place by removable king pins or bolts 10A. Where space or weight considerations make it desirable, particularly when the machine is being moved about inside a mine, the machine may be separated into two parts or one pin or bolt only removed so that the machine may be articulated to negotiate a tight turn.

A double drum slusher hoist 12 and a power pack, consisting of a hydraulic power system 13 and a prime mover 14, which may be an electric motor or an internal combustion engine, are located on deck 1A. If an air motor powered hoist is used for the slusher a source of air under pressure, not shown, may also be provided.

As will hereinafter be described, the space between the side members is kept free for slushing. The platforms 1 and 1A are rigidly constructed so that they will be self-supporting without supports in the space between the side beams. For example each deck section may be made of two flat plates 15, 16 connected by intervening perpendicular ribs 17. The platforms may be bolted, riveted or welded to the top plates 11 and 11A of the side frame members 4 and 6 and corresponding top plates of the side frame members 5 and 7 as indicated at 19 in FIG. 5. The numeral 18A indicates the top plate of side frame member 7 in FIG. 5.

Bottom plates 16 of the deck sections are made to completely cover the space between the side beams from the front to the rear of the machine so that a closed channel is provided underneath for slushing. If desired, hubs 20, 21 may be attached to the side members to rotatably support and retain the axles of wheels 22 as indicated. When wheels are not used the machine rests on the substantially flat bottom surfaces 23, 24 of the side frame members. Said bottom surfaces are inclined at each of their ends so that the machine may be more readily dragged over the surface of the ground during maneuvering and positioning at the mine face. Additional hubs and wheels may be provided if desired.

Figure 1:
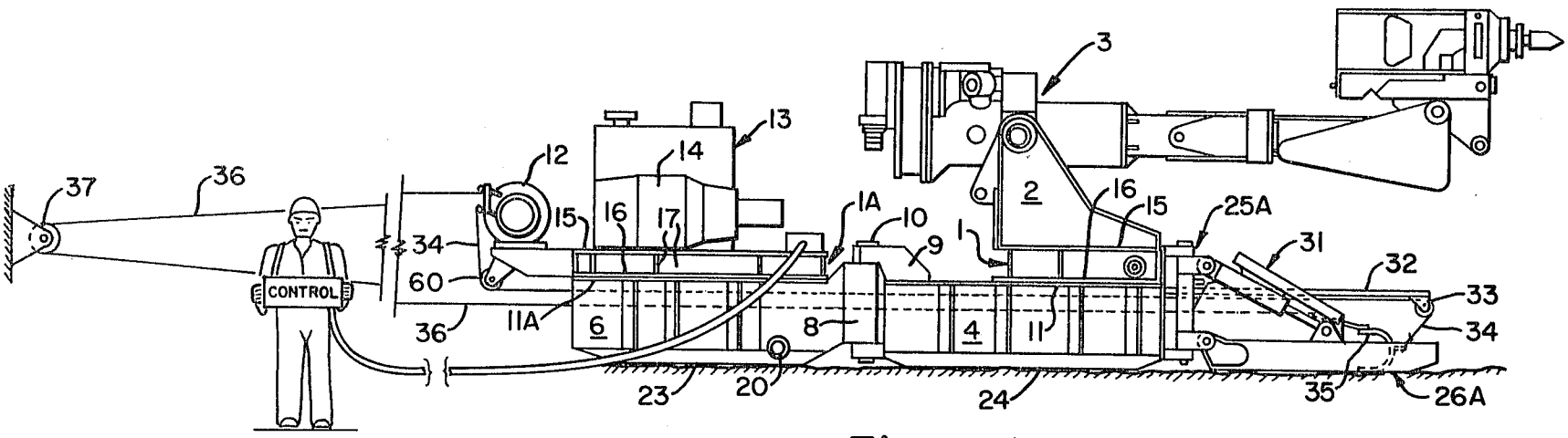
FIG. 1 is an elevation view of the complete machine in position for mining and mucking.

As best seen in FIG. 4, front extensions of the side frame members are provided to support the gathering arms. The gathering arms 26, 26A are of substantial box beam construction and are attached to the front extensions 25, 25A for pivotal motion in both the horizontal and vertical planes by pivots 27 and 28 respectively. The vertical position of each of the gathering arms is controlled by a double acting hydraulic cylinder 29 and the horizontal position by a double acting hydraulic cylinder 30. As shown in FIGS. 1 and 3 the gathering arms have curved inner side plates 31 to better suit them for the mucking operation.

A mucking boom or stiff leg 32 is mounted by suitable means (not shown) at the front center of the platform and extends forwardly of the machine. The mucking boom supports a front pulley 33 over which is threaded a cable 34 attached to a slushing blade 35 to draw the blade in a forward direction when the cable is pulled over the pulley. The other end of the cable passes around pulley 60 and is wound over one of the drums of the slusher hoist 12 at the back of the machine. Another cable 36 is connected to the opposite side of the slushing scraper, threads over a remote pulley 37 and is wound over another drum of the slusher hoist. When the hoist is operated to wind up cable 34 blade 35 will be moved forward passing over the muck or broken ore. When the hoist is operated so that the cable 36 is wound up on its drum, blade 35 is pulled toward the rear of the machine and digs into the muck, conveying it between the side frame members and out the back of the machine where it can be loaded and/or conveyed out of the mine by the mine transportations system, not shown.

Figure 2:
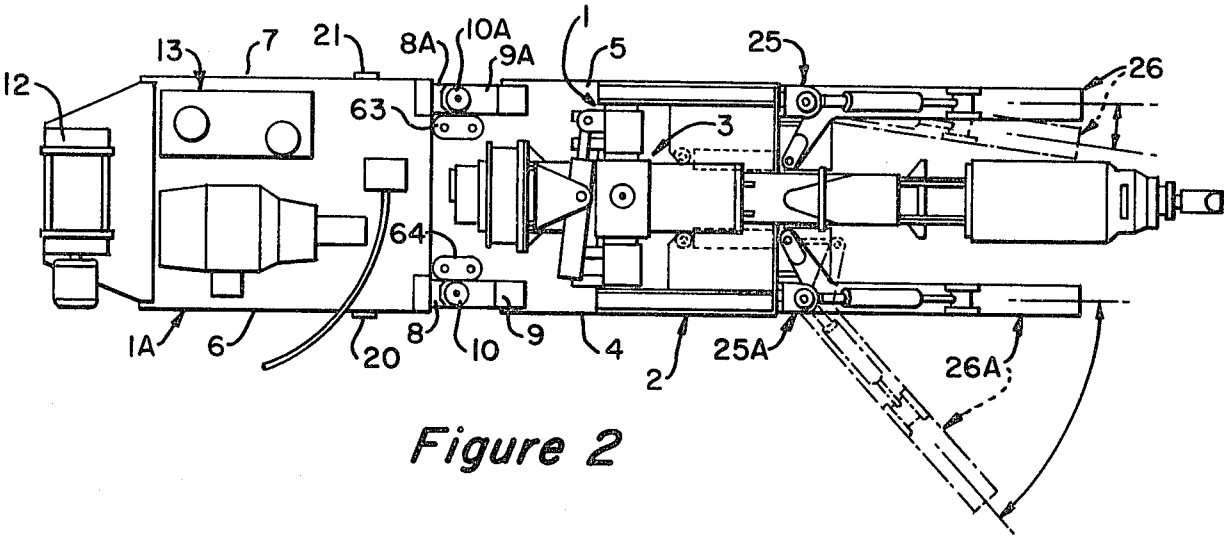
FIG. 2 is a plan view of the machine in FIG. 1 with alternative positions of the mucking arms shown by broken lines, one mucking arm being shown inclined toward the center and the other shown near its extreme outward swing. The plates on the mucking arms are not shown in FIG. 2.

An optional form of mucker is shown in FIGS. 6 and 7. This slushing device may consist of a reciprocable frame base assembly constructed of a pair of angles 38 and 61 interconnected by one or more angles or channels 39 and pivotally supporting a series of blades 40 mounted on pivot pins 41, 42. This assembly is in turn supported by suitable guide means 43 for reciprocating motion relative to the bottom plate 16 of the platform sections. The slushing mechanism is made in two parts, one part under each of the platform sections. The two reciprocable frame base assemblies are detachably connected together as by removable pins 62 so they move back and forth in unison. Removable access plates 63 and 64, shown in FIGS. 2 and 6, are provided for permitting removal and replacement of pins 62. One of the reciprocable frame base assemblies, as shown, the one under the main platform 1, is provided with means such as double acting hydraulic cylinder 44 having a piston rod 45 for reciprocating the slusher frame assembly back and forth in the guides. The piston rod is connected to the reciprocable frame base assembly by brackets 64A attached to one of the interconnecting channels 39 and a pivot pin 65. The cylinder 44 is connected to bottom plate 16 of platform 1 by brackets 66 and a pivot pin 67. As the frame assembly and the scraper blades move toward the front of the machine, the blades are free to swing upward and ride over any material lying on the ground but on the reverse stroke the blades are kept from pivoting by the tabs 46 and will dig into the muck and transport it toward the rear of the machine by a distance substantially equal to the length of the stroke. The stroke of the mucker is made slightly longer than the space between adjacent blades so that on each successive stroke the muck is picked up by the next blade.

FIG. 5 illustrates an optional arrangement for mounting wheels on the machine.

In this arrangement a pair of links 47, one on each side of each wheel, are pivoted intermediate their ends to extensions 48 at the rearmost end of the side beams by pivots 58. One each of each link is pivotally connected by pivots 59 to the piston rod 49 of a double acting hydraulic cylinder 50. The other end of each pair of links supports the axle 51 for a wheel 52. A pair of plates or brackets 53, are rigidly secured to the side beams and provided with apertures 55 to receive the pivot pin 57 which supports the hydraulic cylinder 50. When the piston rod 49 of the hydraulic cylinder is retracted the links 47 rotate about the pivot 58 and the wheel 52 moves into ground engaging contact. It is desirable that the axis of axle 51 move past a line 54 perpendicular to the ground and passing through the axis of pivot 58 to create a toggle effect. At this point the piston rod 49 should be fully retracted so that the reaction of the weight of the vehicle on the wheel is taken by the pivot block 56 against the body of cylinder 50 rather than being borne by the piston of hydraulic cylinder 50. When the piston rod 49 of the hydraulic cylinder 50 is extended the links 47 will rotate in a direction which will raise the wheel 52 off of the ground and allow the machine to rest on the bottom surfaces 23, 24 of the side frame members.

With this arrangement the machine can alternatively be raised up on the wheels for improved mobility or allowed to rest on the ground on the skid surfaces to improve its stability during the mining operation. More than one pair of wheels may be provided if desired.

In the alternative form of machine shown in FIGS. 8 and 9, the machine is mounted on a self-propelled chassis 68 which may be of any known configuration including the endless tread crawler type. A deck plate 69 is mounted on the chassis. A pair of slide supports 70 are secured to the deck plate by means of welding, bolts or rivets, not shown, and in turn carry the gimbal supports or pedestals 2 on which are mounted the boom and hammer assembly 3. A king pin clevis 71 is rigidly secured to the rearward portion 72 of the deck plate 69 by welding or other suitable means and supports a cantilevered platform 73. The platform 73 is removably joined to the deck plate 69 by means of the king pin 74 which permits the platform 73 to swing in a horizontal plane. The position of cantilevered platform 73 is controlled by a double acting hydraulic cylinder 75. One end of the cylinder 75 is pivotally connected to deck plate 69 and the piston rod of cylinder 75 is pivotally connected to platform 73 so that the latter can be swung in a horizontal plane through a limited arc to either side of the longitudinal center line of the machine extending through the king pin. An auxiliary platform or deck 73A is rigidly secured to the platform 73 as by welding, rivets or bolts (not shown) and carries the hydraulic power system 13 and the prime mover 14.

The slide supports 70 may each be constructed of an I-beam section closed at its ends by plates 76 and with intermediate plates 77 as web stiffeners. Pedestals 2 have smooth bottom surfaces in sliding contact with the top surfaces 78 of slide supports 70 and are tied together by a channel shaped tie bar 79. As shown in FIG. 10 pedestals 2 are slideably secured to the top flange of the I-beam section of slide supports 70 by angles 80 which engage the edge of the flange and are removeably secured to the pedestals 2 by bolts 82. The pedestals 2 and the gimbal assembly can be moved and retained in a forward position as shown in FIGS. 8 and 9 or slid along slide support 70 to the position shown by the broken line of FIG. 9 or to intervening positions by a double acting hydraulic cylinder 83, the piston rod of which is pivotally attached to brackets 105 at the rear of slide support 70 by a pin 107 and the cylinder of which is pivotally attached to brackets 81 on the tie bar 79 by a pin 84. FIG. 10 shows one pedestal, the other being substantially a mirror image on the other side of the machine.

As seen in FIG. 8 bulldozer blade 86 is mounted at the front of the chassis 68 by means of a U-shaped bracket 90 comprising a pair of arms 87 and 88 and a back plate 89 connecting the arms. The bracket 90 is mounted for pivotal motion in a vertical direction by pivots 91 connecting the free ends of arms 87 and 88 to frame members 85 on each side of the chassis 68. The vertical position of blade 86 is controlled by double acting hydraulic cylinder 92 pivoted to brackets 93 on the front of deck plate 69 and which has its piston rod pivotally attached to back plate 89 by suitable means, not shown.

Bulldozer blade 86 is pivotally secured to the front end of arm 87 for pivotal motion in the horizontal plane by a double clevis arrangement 94, 95. A double acting hydraulic cylinder 96 is pivotally secured to arm 88 by suitable means, not shown, and has its piston rod pivotally attached to the rear of blade 86 by suitable means, not shown. Arm 87 of support bracket 90 is longer than arm 88 and back plate 89 is inclined rearward from left to right as viewed in FIG. 8 so than when hydraulic cylinder 96 is actuated to pull bulldozer blade 86 back against back plate 89 the right hand end of the blade will be rearwardly inclined with respect to the left end of the blade so that material being pushed by the blade will move from left to right. When hydraulic cylinder 96 is extended, the right end of blade 86 can be moved forward of the left end so that material being pushed by the blade will move from right to left.

As shown in FIG. 9, the machine may alternatively be provided with a boom mounted bucket for mucking. As shown, a bucket 97, which may be of any conventional known type, is mounted on an extendable boom 98. As shown, the bucket is of the side dump type. Boom 98 may also be of any known type capable of supporting the bucket. The boom 98 is mounted for pivotal motion in a vertical plane about the pivot 99 and may also be swung in a horizontal plane about the pivot means 100. Elevation of the boom about pivot 99 is controlled by a hydraulic cylinder 101 suitably attached between boom 98 and pivot 100. Horizontal swing of boom 98 is controlled by hydraulic cylinder 102 suitably connected between brackets 103 which are in turn rigidly secured to pivot means 100 and a fixed point on the deck plate 69. In addition to being hinged for side dumping motion controlled by suitable means such as a hydraulic cylinder, not shown, bucket 97 is hinged to boom 98 for vertical oscillation controlled by hydraulic cylinder 104, all as well known in the art. Any suitable known form of bucket and control means may be used in place of the side dump bucket and control means shown.

In the alternative structure of the machine shown in FIGS. 8 and 9, the hammer and boom assembly can be retracted after being used for breaking ore from the mine face. With the boom and hammer assembly out of the way, the broken ore can be picked up with the bucket or be pushed away by the alternative bulldozer blade to conveying means for moving the broken ore out of the mine.

While specific embodiments of the invention have been shown and described, it will be evident that numerous changes and variations may be made in the details thereof without departing from the invention as defined and claimed in the appended claims.

What I claim is:

1. A mining machine for underground mining in relatively hard rock formations, comprising a first section supporting a mining implement capable of breaking ore from the solid, said first section having a first deck supported on first side beam members on each side of the machine and having ground engaging skid surfaces, and a second section supporting a source of power for said mining implement, said second section having a second deck supported on second side beam members on each side of the machine and having ground engaging skid surfaces, said first and second side beam members on the respective same side of the machine being substantially alignable with each other and said first and second sections being detachably joined to each other by a pivot mounted near each side of said machine, support means associated with said first deck for supporting the mining implement on said first deck and means for moving along the ground at least one of said first and second sections.

2. A mining machine as defined in claim 1 wherein said first section has a front and wherein said moving means comprise means for moving said front of said first section longitudinally, laterally and vertically.

3. The mining machine of claim 1 wherein said mining implement includes an extensible boom and hammer assembly, and further comprising means interposed between said first deck and said mining implement for positioning said implement to break ore from the solid over a mine face having an area at least as great as the largest longitudinal cross sectional silhouette of the mining machine.

4. The mining machine of claim 1 wherein said mining implement is a hammer mounted on an extensible boom and engageable with the ground to obtain a purchase against which force can be exerted to move said first section relative to said second section upon detachment of said pivots.

5. The mining machine of claim 1 wherein each side beam member of said first section has a forward extremity and further comprising two arms, each said arm being attached to said forward extremity of said side beam members, said arms being pivotal independently from each other to gather muck in front of said machine toward the center of said machine, said arms being further pivotable to obtain a purchase against the ground against which force can be exerted to move said first section relative to said second section upon detachment of at least one of said pivots.

6. A mining machine as defined in claim 1 further comprising two arms extending outwardly from said first section independently pivotable horizontally and vertically, said arms being selectively operable to engage mine surfaces to move said machine, to engage mine surfaces to stablize said machine, and to gather broken ore from in front of said machine toward the longitudinal center of said machine.

7. A mining machine for underground mining in relatively hard rock formations, comprising a first section supporting a mining implement capable of breaking ore from the solid, said first section comprising first side beam members on each side of the machine having ground engaging skid surfaces and a first deck attached to said first side members so as to form a first closed channel underneath said first deck, and a second deck section hingedly connected to said first section and supporting a source of power for said mining implement, said second section comprising second side beam members on each side of the machine having ground engaging skid surfaces and a second deck attached to said second side members so as to form a second closed channel underneath said second deck, said first and second channels being longitudinally alignable, and means for moving said broken ore through said channels underneath said machine.

8. A mining machine as set forth in claim 7, having means for gathering ore broken from the mine face toward the longitudinal centerline of the machine and slushing means for moving the broken ore underneath the machine through said channels.

9. A continuous mining machine as set forth in claim 8 wherein the slushing means is capable of moving the broken ore from a point in front of the forward extremity of the side beam members of said first section to a point behind the rearmost extremity of the side beam members of said second section in one continuous movement.

10. A mining machine as described in claim 8 in which said second deck section also supports means for providing power to the slushing means.

11. A mining machine as defined in claim 7 further comprising two arms extending outwardly from said first section independently pivotable horizontally and vertically, said arms being selectively operable to engage mine surfaces to move said machine, to engage mine surfaces to stabilize said machine, and to gather broken ore from in front of said machine toward the longitudinal center of the machine.

* * * * *